US010893766B2

(12) United States Patent
Lai et al.

(10) Patent No.: US 10,893,766 B2
(45) Date of Patent: Jan. 19, 2021

(54) PLANT FIBER STRAW STRUCTURE

(71) Applicants: Chih Chin Lai, Taipei (TW); Pi Yi Chen, Taipei (TW)

(72) Inventors: Chih Chin Lai, Taipei (TW); Pi Yi Chen, Taipei (TW)

(73) Assignee: Taiwan Plants Fiber Tech Alliance Co., LTD., Taipei (TW)

( * ) Notice: Subject to any disclaimer, the term of this patent is extended or adjusted under 35 U.S.C. 154(b) by 32 days.

(21) Appl. No.: 16/395,271

(22) Filed: Apr. 26, 2019

(65) Prior Publication Data

US 2019/0246823 A1 Aug. 15, 2019

(30) Foreign Application Priority Data

Nov. 22, 2018 (TW) ..... 107215890 U

(51) Int. Cl.
*A47G 21/18* (2006.01)

(52) U.S. Cl.
CPC ..... *A47G 21/18* (2013.01); *A47G 2400/10* (2013.01)

(58) Field of Classification Search
CPC ... A47G 21/18; A47G 21/185; A47G 2400/10
USPC ..... 239/33
See application file for complete search history.

(56) References Cited

U.S. PATENT DOCUMENTS 662,345 A * 11/1900 Britton et al. ..... 239/33
2015/0014431 A1* 1/2015 Whittaker ..... A47G 21/182 239/33

* cited by examiner

*Primary Examiner* — Christopher S Kim

(57) ABSTRACT

An environmentally-friendly fiber straw structure includes a straw body made of an environmentally-friendly fiber material. The straw body has an inlet and an outlet at two ends thereof and a circular section having a circular cross-section between the inlet and the outlet. From the circular section to the outlet forms a first tapered section at a first inclination so that the outlet has an approximately elliptical shape. When in use, the mouth of a user sucks the outlet of the straw body for drinking a beverage, the first tapered section corresponds in shape to the mouth, thereby avoiding rotation of the straw body, reducing a gap between the mouth and the straw body.

8 Claims, 8 Drawing Sheets

PLANT FIBER STRAW STRUCTURE

FIELD OF THE INVENTION

The present invention relates to a straw structure, and more particular to, an environmentally friendly fiber straw structure that reduces environmental pollution and increases suction comfort for the mouth.

BACKGROUND OF THE INVENTION

In these days, most drinking straws are made of a plastic material, and some of them may have various color patterns. However, when using plastic straws to suck various beverages or acidic beverages, the plastic straw easily releases plasticizers or some metal components which are harmful to the health of the user.

Plastic straws are usually discarded after use. Plastic straws are a permanent waste that is not easily decomposed. Burning plastic will produce toxic gas, dioxin, which will cause cancer and harm the immune system and hormones of the human body. Therefore, straws made of stainless steel are developed on the market. But, the cleaning of stainless steel straws still has many problems. When the stainless steel straw is not clean, the bacteria inside the straw will be ingested next time, which may cause discomfort or illness.

Accordingly, the inventor of the present invention has devoted himself based on his many years of practical experiences to solve these problems and develop an environmentally friendly fiber straw structure.

SUMMARY OF THE INVENTION

The primary object of the present invention is to provide an environmentally-friendly fiber straw structure, comprising a straw body made of an environmentally-friendly fiber material (in this embodiment, it is sugar cane fiber, tea fiber or plant fiber). The straw body has an inlet and an outlet at two ends thereof and a circular section having a circular cross-section between the inlet and the outlet. From the circular section to the outlet forms a first tapered section at a first inclination so that the outlet has an approximately elliptical shape.

Preferably, two sides of the outlet each have a first fold line.

Preferably, from the circular section to the inlet forms has a second tapered section at a first inclination so that the inlet has an approximately elliptical shape, and two sides of the inlet each have a second fold line.

Preferably, the inlet is provided with a pointed portion protruding outwardly from one of the second fold lines of the two sides of the inlet.

Embodiments of the present invention will now be described, by way of example only, with reference to the accompanying drawings.

DETAILED DESCRIPTION OF THE PREFERRED EMBODIMENTS

Figure 1:
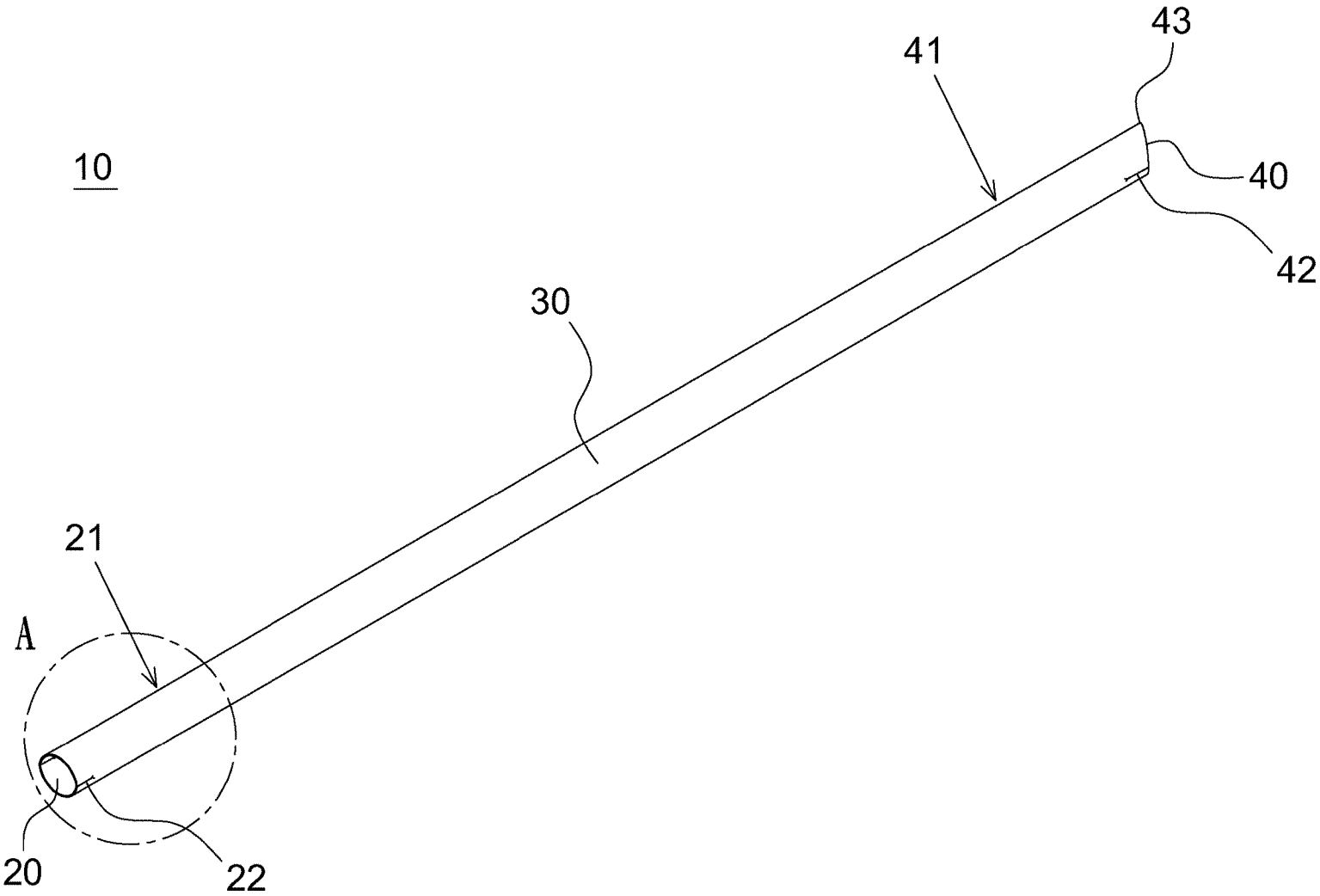
FIG. 1 is a first perspective view of the present invention.
Figure 1A:
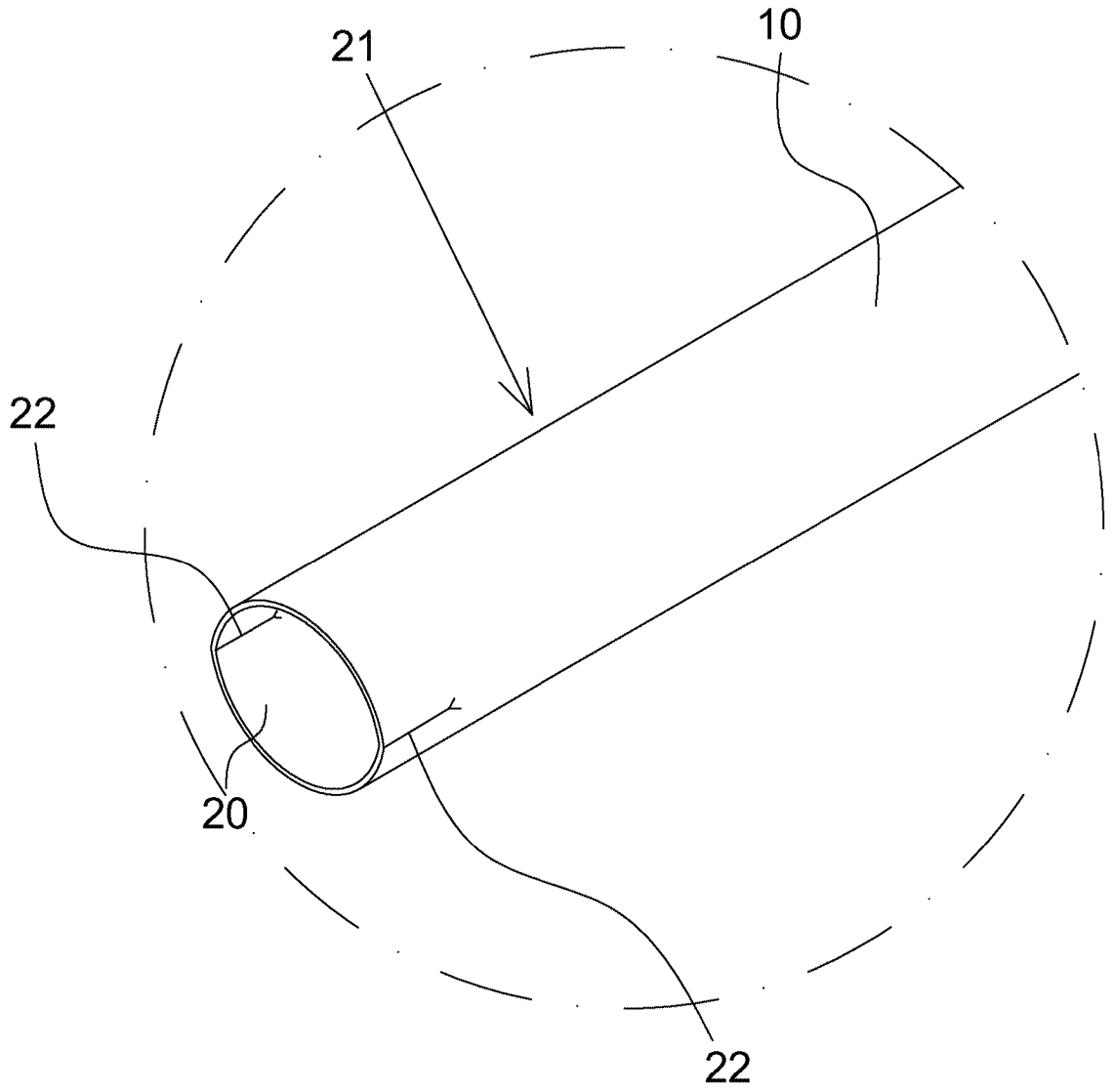
FIG. 1A is a partial enlarged view of circle A of FIG. 1.
Figure 2:
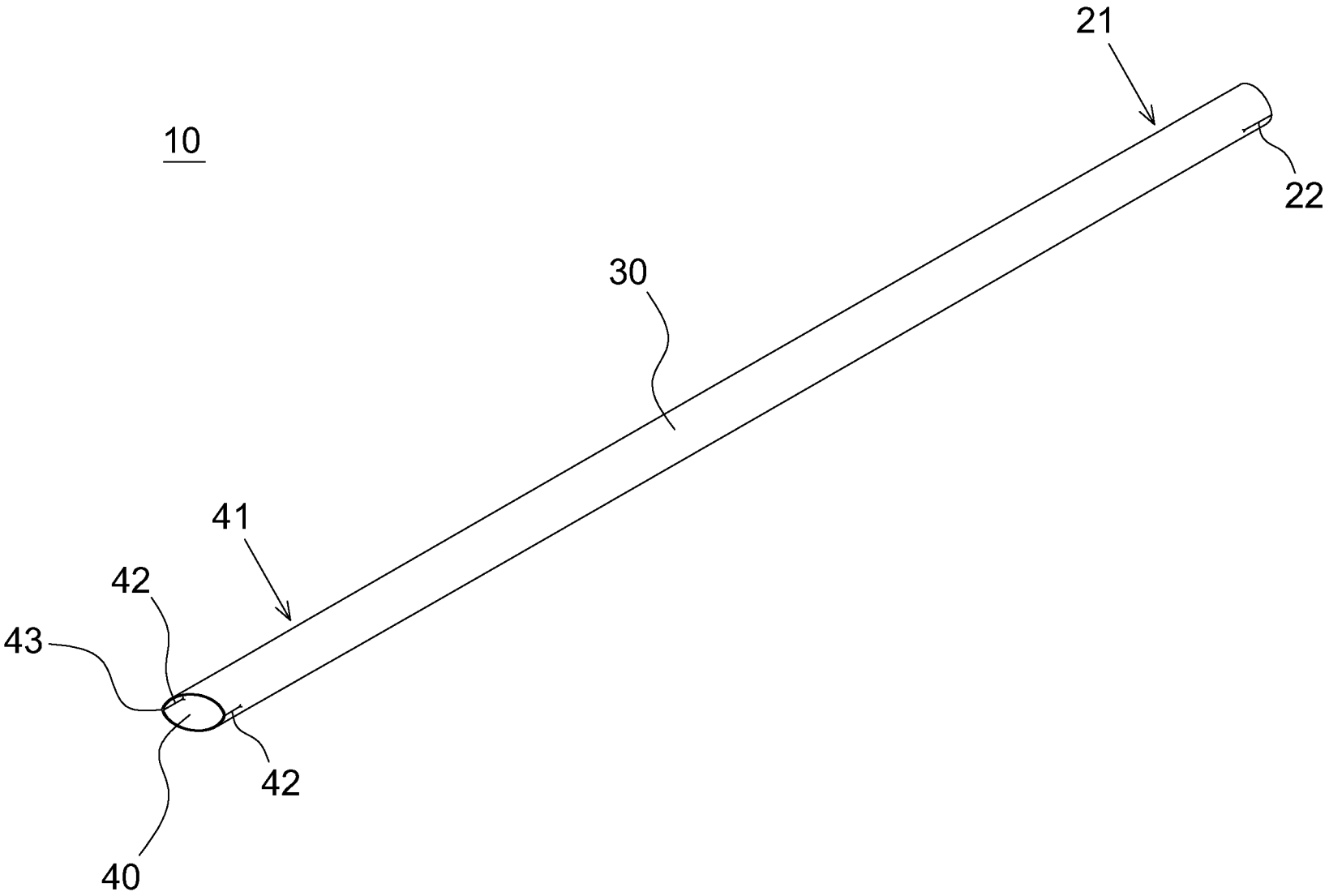
FIG. 2 is a second perspective view of the present invention.
Figure 3:
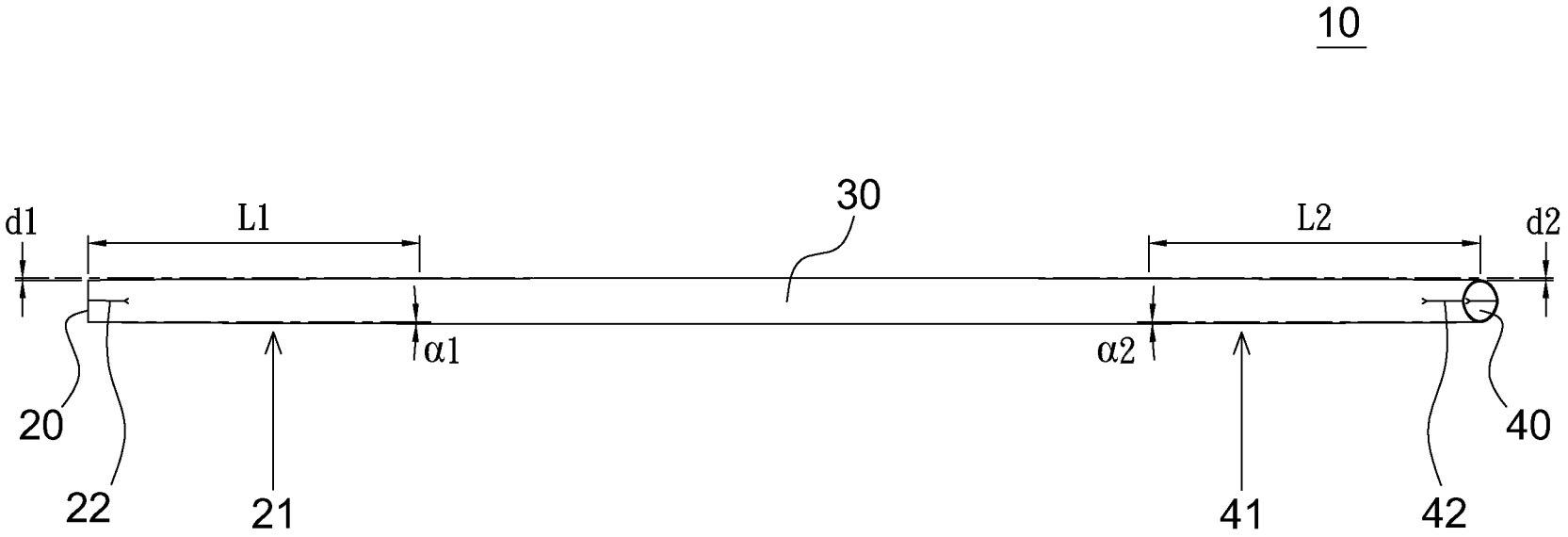
FIG. 3 is a schematic view of the present invention, showing the inclination of the first tapered section.

Referring to FIG. 1 to FIG. 3, plant fiber straw structure comprises a straw body 10 made of a plant fiber material that is easy to be decomposed. The straw body 10 has an inlet 40 and an outlet 20 at two ends thereof and a circular section 30 having a circular cross-section between the inlet 10 and the outlet 20. From the circular section 30 to the outlet 20 forms a first tapered section 21 at a first inclination $\alpha$1, so that the outlet 20 has an approximately elliptical shape. As to the above plant fiber material, please refer to Taiwan Patent Publication No. 201107124.

Furthermore, the first inclination $\alpha$1 is 1:300 to 6:300. The first inclination $\alpha$1 implemented by the present invention is 1:100, namely, the ratio of the compression height d1 and the length of the first tapered section 21. When the compression height d1 of the first tapered section 21 is 0.1 mm, the length L1 of the first tapered section 21 is 10 mm.

The length L1 of the first tapered section 21 of the present invention is 3 cm.

Figure 4:
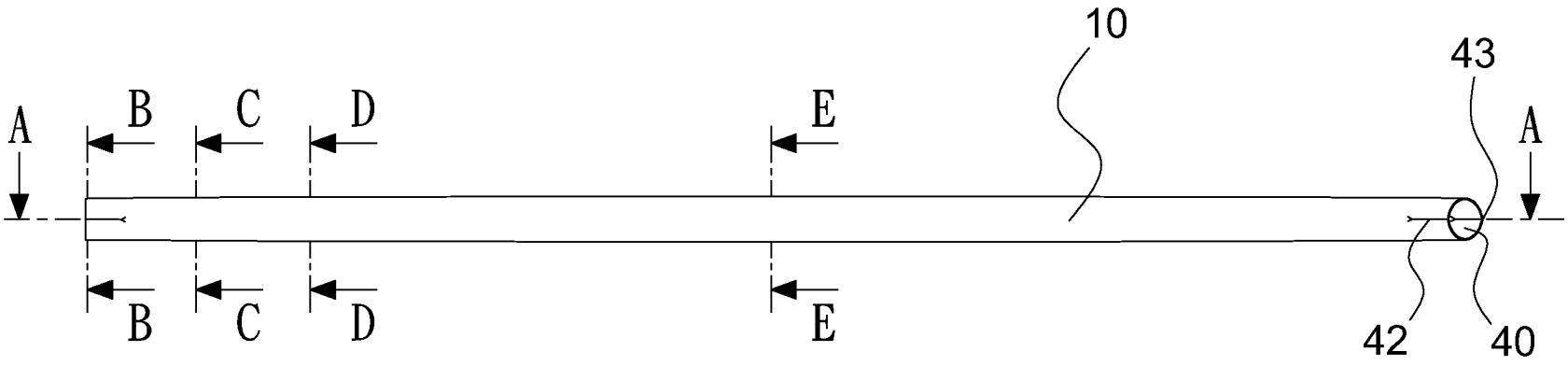
FIG. 4 is a cross-sectional view of the present invention.
Figure 4A:
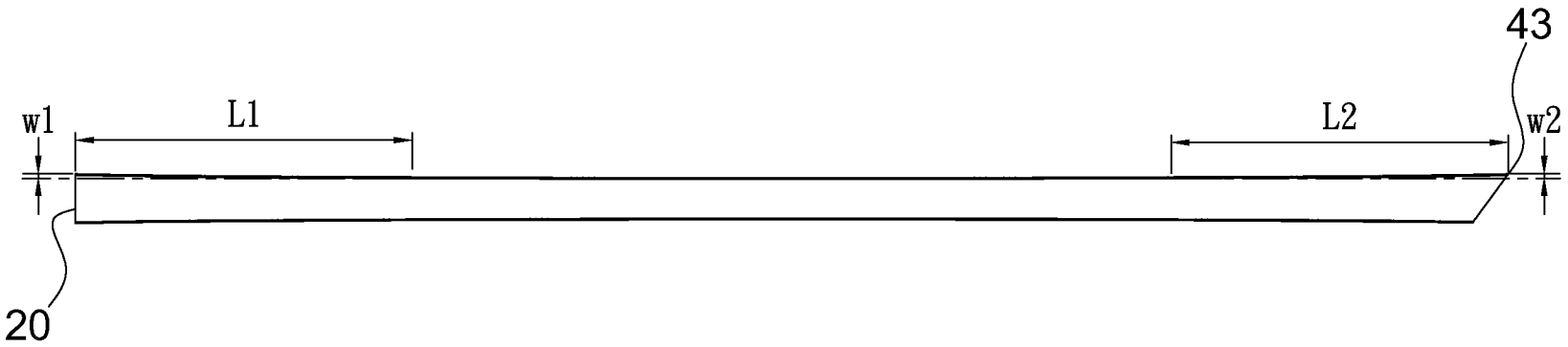
FIG. 4A is a cross-sectional view taken along line A-A of FIG. 4.
Figure 4C:
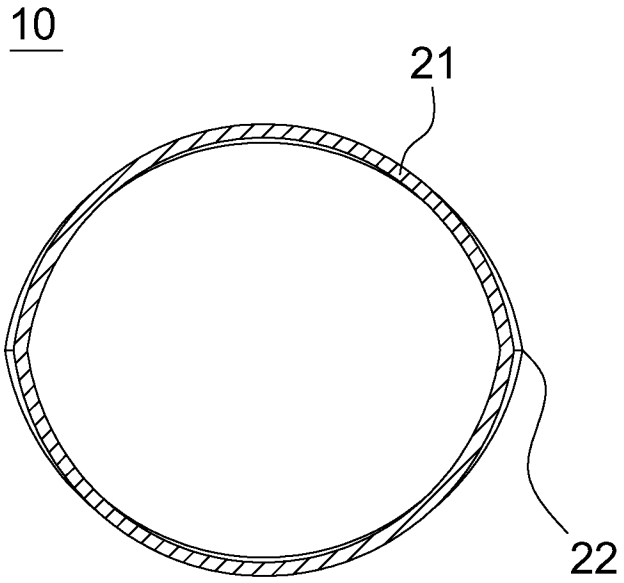
FIG. 4C is a cross-sectional view taken along line C-C of FIG. 4.
Figure 4B:
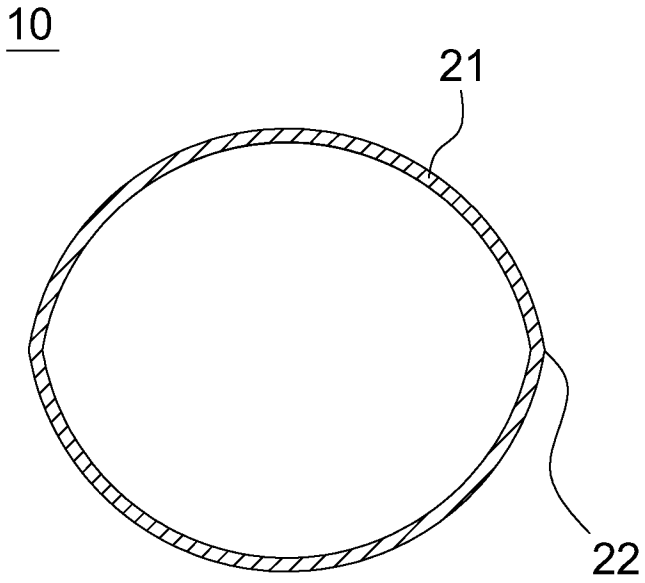
FIG. 4B is a cross-sectional view taken along line B-B of FIG. 4.
Figure 4E:
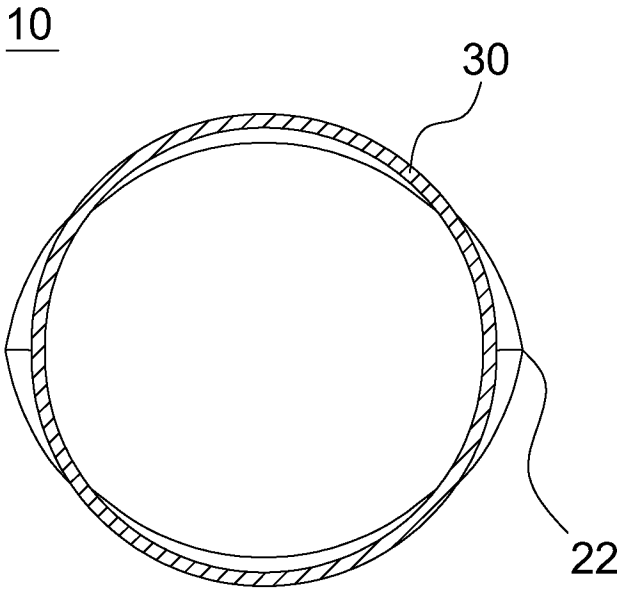
FIG. 4E is a cross-sectional view taken along line E-E of FIG. 4.
Figure 4D:
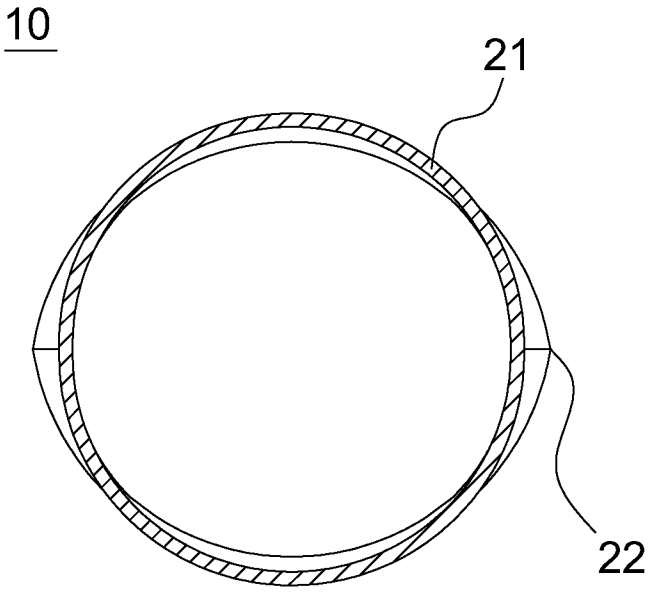
FIG. 4D is a cross-sectional view taken along line D-D of FIG. 4.

Referring to FIG. 4 to FIG. 4A, when the compression height of the first tapered section 21 is d1, two sides of the first tapered section 21 each extend outwardly to have an extension width w1. The ratio of the extension width w1 of the first tapered section 21 implemented by the present invention 21 to the length L1 of the first tapered section 21 is 1:50, and the cross-sectional area of the first tapered section 21 is unchanged.

Referring to FIG. 3 to FIG. 4E and FIG. 1A, two sides of the outlet 20 each have a first fold line 22. The first fold line 22 of the present invention has a length of 3 mm.

From the circular section 30 to the inlet 40 forms a second tapered section 41 at a first inclination $\alpha$2, so that the inlet 40 has an approximately elliptical shape. Two sides of the inlet 40 each have a second fold line 42. The first fold line 42 of the present invention has a length of 3 mm.

In detail, the second inclination $\alpha$1 is 1:300 to 6:300. The second inclination $\alpha$2 implemented by the present invention is 1:100, namely, the ratio of the compression height d2 and the length of the second tapered section 41. When the compression height d2 of the second tapered section 41 is 0.1 mm, the length L2 of the second tapered section 41 is 10 mm.

The length L2 of the second tapered section 41 of the present invention is 3 cm.

When the compression height of the second tapered section 41 is d2, two sides of the second tapered section 41 each extend outwardly to have an extension width w2. The ratio of the extension width w2 of the second tapered section 41 implemented by the present invention to the length L2 of the second tapered section 41 is 1:50, and the cross-sectional area of the second tapered section 41 is unchanged.

Preferably, the inlet 40 is provided with a pointed portion 43 protruding outwardly from one of the second fold lines 42 of the two sides of the inlet 40 for penetrating a plastic sealing film to drink a beverage.

Figure 5:
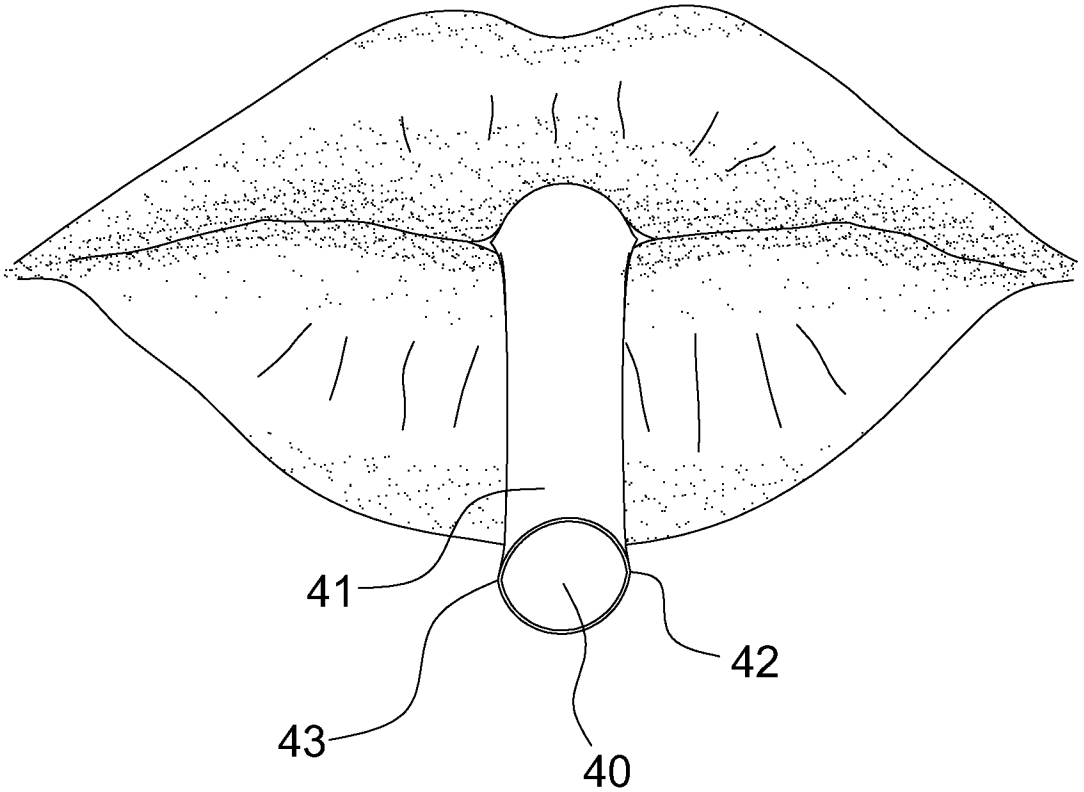
FIG. 5 is a schematic view of the present invention when in use.

Finally, referring to FIG. 5 and FIG. 2, when in use, the mouth of a user sucks the outlet 20 of the straw body 10 for drinking a beverage, the first tapered section 21 corresponds in shape to the mouth, thereby avoiding rotation of the straw body 10, reducing the gap between the mouth and the straw body 10, and improving suction comfort.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A plant fiber straw structure, comprising a straw body including an inlet at one end and an outlet at the other end and a circular section having a circular cross-section between the inlet and the outlet, from the circular section to the outlet forming a first tapered section at a first slope ratio so that the outlet has an approximately elliptical shape;

wherein the first slope ratio is in the range between 1 in 300 and 1 in 50; and wherein the first tapered section has a length of 1-5 cm.

2. The plant fiber straw structure of claim 1, wherein two sides of the outlet each have a first fold line.

3. The plant fiber straw structure of claim 2, wherein the first fold line has a length of 1-12 mm.

4. The plant fiber straw structure of claim 1, wherein from the circular section to the inlet forms a second tapered section at a second slope ratio so that the inlet has an approximately elliptical shape, and two sides of the inlet each have a second fold line.

5. The plant fiber straw structure of claim 4, wherein the inlet is provided with a pointed portion protruding outwardly from one of the second fold lines of the two sides of the inlet.

6. The plant fiber straw structure of claim 4, wherein the second slope ratio is in the range between 1 in 300 and 1 in 50.

7. The plant fiber straw structure of claim 4, wherein the second tapered section has a length of 1-5 cm.

8. The plant fiber straw structure of claim 4, wherein the second fold line has a length of 1-12 mm.

* * * * *